US009789991B2

(12) United States Patent
Cooper

(10) Patent No.: US 9,789,991 B2
(45) Date of Patent: Oct. 17, 2017

(54) REACTOR PLATE ASSEMBLY AND BRUSH ANVIL FOR USE IN CONJUNCTION THEREWITH

(71) Applicant: Avery Dennison Corporation, Glendale, CA (US)

(72) Inventor: William J. Cooper, Shrewsbury, MA (US)

(73) Assignee: Avery Dennison Corporation, Glendale, CA (US)

( * ) Notice: Subject to any disclaimer, the term of this patent is extended or adjusted under 35 U.S.C. 154(b) by 533 days.

(21) Appl. No.: 14/012,762

(22) Filed: Aug. 28, 2013

(65) Prior Publication Data

US 2015/0060515 A1 Mar. 5, 2015

(51) Int. Cl.
*B65C 7/00* (2006.01)

(52) U.S. Cl.
CPC ..... *B65C 7/003* (2013.01)

(58) Field of Classification Search
CPC ..... B65C 7/00
USPC ..... 227/67, 73, 76, 97, 10, 156
See application file for complete search history.

(56) References Cited

U.S. PATENT DOCUMENTS

| | | | |
|---|---|---|---|
| 3,354,539 | A | 11/1967 | Hibbard |
| 3,742,802 | A | 7/1973 | Maerz |
| 3,815,221 | A | 6/1974 | Pearl |
| 3,875,648 | A | 4/1975 | Bone |
| 4,039,078 | A | 8/1977 | Bone |
| 4,111,347 | A | 9/1978 | Bone |
| 4,288,017 | A | 9/1981 | Russell |
| 4,456,123 | A | 6/1984 | Russell |
| 4,456,161 | A | 6/1984 | Russell |

(Continued)

FOREIGN PATENT DOCUMENTS

| | | |
|---|---|---|
| CN | 1094366 | 11/1994 |
| CN | 1191197 | 8/1998 |

(Continued)

OTHER PUBLICATIONS

International Search Report and Written Opinion prepared for PCT/US2014/053043 dated Jan. 16, 2015.

(Continued)

*Primary Examiner* — Nathaniel Chukwurah
(74) *Attorney, Agent, or Firm* — Avery Dennison Corporation

(57) ABSTRACT

A reactor plate assembly for a fastener dispensing device includes a metal reactor plate mounted onto the distal end of a fixed support arm for the device, the reactor plate including a flattened top surface shaped to define a pair of elliptical, needle-receiving holes. The reactor plate assembly additionally includes a brush anvil removably secured to the underside of the support arm. The brush anvil includes four separate bristle clusters that are retained within associated bores in a block, with a first pair of bristle clusters projecting into one needle-receiving hole and a second pair of bristle clusters projecting into the other needle-receiving hole. Each bristle cluster includes a group of individual nylon bristles, the free ends of the bristles lying flush with the top surface of the reactor plate to provide a planar support surface which can be penetrated by the needles of the device during the dispensing process.

13 Claims, 6 Drawing Sheets

(56) References Cited

U.S. PATENT DOCUMENTS

| | | | | |
|---|---|---|---|---|
| 4,592,499 | A | 6/1986 | Kato | |
| 4,640,222 | A | 2/1987 | Gerber | |
| 4,640,320 | A | 2/1987 | Avison et al. | |
| 4,664,306 | A | 5/1987 | Levy | |
| 4,712,677 | A | 12/1987 | Russell | |
| 4,955,475 | A | 9/1990 | McCarthy et al. | |
| 5,020,713 | A | 6/1991 | Kunreuther | |
| 5,038,931 | A | 8/1991 | Kunreuther | |
| 5,042,535 | A | 8/1991 | Schlottke | |
| 5,092,829 | A | 3/1992 | Gerber | |
| 5,205,458 | A | 4/1993 | Kunreuther | |
| RE34,857 | E | 2/1995 | Kunreuther | |
| RE34,858 | E | 2/1995 | Kunreuther | |
| RE34,891 | E | 4/1995 | Kunreuther | |
| 5,579,976 | A | 12/1996 | Kunreuther | |
| 5,615,816 | A | 4/1997 | Deschenes et al. | |
| 5,678,746 | A | 10/1997 | Grendol | |
| 5,678,747 | A | 10/1997 | Kunreuther | |
| 5,755,371 | A | 5/1998 | Huang | |
| 5,810,238 | A | 9/1998 | Kunreuther | |
| 5,931,298 | A | 8/1999 | Huang | |
| 5,950,901 | A | 9/1999 | Kubota | |
| 5,967,316 | A | 10/1999 | Abbruzzese et al. | |
| 6,220,434 | B1 | 4/2001 | Kubota et al. | |
| 6,244,490 | B1 * | 6/2001 | Flannery | B26D 7/20 227/140 |
| 6,318,553 | B1 | 11/2001 | Deschenes | |
| 6,371,293 | B2 | 4/2002 | Kubota et al. | |
| 6,427,895 | B1 | 8/2002 | Deschenes | |
| 6,536,648 | B2 * | 3/2003 | Flannery | B65C 7/006 227/140 |
| 6,561,405 | B2 | 5/2003 | Flannery et al. | |
| 6,561,406 | B1 | 5/2003 | Furutsu | |
| 6,564,939 | B1 | 5/2003 | Deschenes et al. | |
| 6,569,369 | B2 | 5/2003 | Shilale | |
| 6,732,899 | B2 | 5/2004 | Franks | |
| 7,036,680 | B1 | 5/2006 | Flannery et al. | |
| 7,308,983 | B2 | 12/2007 | Shilale et al. | |
| 7,444,922 | B2 | 11/2008 | Harashima et al. | |
| 7,681,730 | B2 | 3/2010 | Cooper et al. | |
| 8,413,866 | B2 | 4/2013 | Cooper | |
| 8,657,172 | B2 | 2/2014 | Cooper | |
| 2002/0179672 | A1 | 12/2002 | Flannery et al. | |
| 2003/0218043 | A1 | 11/2003 | Cooper et al. | |
| 2004/0205939 | A1 | 10/2004 | Cooper et al. | |
| 2008/0164271 | A1 | 7/2008 | Cooper et al. | |
| 2008/0190956 | A1 * | 8/2008 | Earley | B65C 7/00 221/74 |
| 2012/0279023 | A1 | 11/2012 | Burout et al. | |

FOREIGN PATENT DOCUMENTS

| | | |
|---|---|---|
| CN | 2478931 | 2/2002 |
| CN | 2478932 | 2/2002 |
| CN | 1341539 | 3/2002 |
| CN | 2513732 | 10/2002 |
| CN | 1408619 | 4/2003 |
| CN | 2550270 | 5/2003 |
| CN | 2567156 | 8/2003 |
| CN | 1457311 | 11/2003 |
| CN | 200964193 | 10/2007 |
| CN | 101104983 | 1/2008 |
| CN | 101184668 | 5/2008 |
| CN | 201087255 | 7/2008 |
| CN | 201089535 | 7/2008 |
| CN | 201115438 | 9/2008 |
| CN | 101362521 | 2/2009 |
| CN | 101450719 | 6/2009 |
| CN | 101628637 | 1/2010 |
| CN | 101734392 | 6/2010 |
| CN | 201619718 | 11/2010 |
| CN | 201633970 | 11/2010 |
| CN | 201712833 | 1/2011 |
| CN | 201751304 | 2/2011 |
| CN | 102046475 | 5/2011 |
| CN | 201849699 | 6/2011 |
| CN | 102844242 | 12/2012 |
| DE | 2805034 | 8/1979 |
| DE | 3115112 | 4/1982 |
| DE | 3213933 | 11/1982 |
| DE | 3512747 | 10/1985 |
| DE | 19748592 | 5/1999 |
| EP | 0888727 | 1/1999 |
| GB | 2053296 | 2/1981 |
| JP | 0161019 | 4/1989 |
| KR | 100679188 | 2/2007 |
| WO | 9410044 | 5/1994 |
| WO | 97/20664 | 6/1997 |
| WO | 20041094236 | 11/2004 |
| WO | 2005/005265 | 1/2005 |
| WO | 2005005265 A2 | 1/2005 |
| WO | 2010/081042 | 7/2010 |

OTHER PUBLICATIONS

International Preliminary Report on Patentability Chapter I prepared for PCT/US2014/053043 dated Mar. 1, 2016.

International Search Report and Written Opinion dated Jan. 16, 2015 for Internation Application No. PCT/US2014/053043 filed Aug. 28, 2014.

International Search Report and Written Opinion dated Dec. 17, 2012 for Internation Application No. PCTIUS2011/062187 filed Nov. 28, 2011.

International Search Report and Written Opinion dated Feb. 6, 2012 for Internation Application No. PCT/US2011/062189 filed Nov. 28, 2011.

International Search Report dated Feb. 14, 2012 for International Application No. PCT/US2011/062205 filed Nov. 28, 2011.

Written Opinion dated Feb. 14, 2012 for International Application No. PCT/US2011/062205 filed Nov. 28, 2011.

* cited by examiner

REACTOR PLATE ASSEMBLY AND BRUSH ANVIL FOR USE IN CONJUNCTION THEREWITH

FIELD OF THE INVENTION

The present invention relates generally to plastic fasteners and more particularly to devices for dispensing plastic fasteners.

BACKGROUND OF THE INVENTION

Plastic fasteners are commonly utilized in the retail industry in a variety of different applications to couple together two or more separate items. For instance, plastic fasteners are often used to couple together (i) a pair of complementary articles of clothing, such as socks, gloves and the like, (ii) a merchandise tag, or ticket, to one or more articles of clothing (e.g., a merchandise ticket folded over the waistline of a pair of jeans), and (iii) a handheld tool, or instrument, to a merchandise display card (e.g., a screwdriver disposed against the front surface of a flat, cardboard display card).

In U.S. Pat. No. 4,039,078 to A. R. Bone, the disclosure of which is incorporated herein by reference, there are disclosed several different types of plastic fasteners. Each plastic fastener described in the patent is manufactured in a generally H-shaped configuration, with two shortened parallel cross-bars, or T-bars, being interconnected at their appropriate midpoints by a thin, flexible filament which extends orthogonally therebetween.

Plastic fasteners of the type described above are commonly fabricated as part of a continuously connected supply of fastener stock, which is also commonly referred to in the art simply as ladder stock due to its ladder-like appearance. Referring now to FIG. 1, there is shown a length of ladder stock that is presently manufactured and sold by Avery Dennison Corporation of Pasadena, Calif. under the PLASTIC STAPLE® and ELASTIC STAPLE® lines of plastic fasteners. As can be seen, a length of ladder stock is shown that is preferably produced from one or more flexible plastic materials, such as nylon, polypropylene and the like, the ladder stock being identified generally by reference numeral 11. Ladder stock 11 comprises a pair of elongated and continuous side members, or rails, 13 and 15 which are interconnected by a plurality of equidistantly spaced cross-links 17.

An individual plastic fastener 18 is obtained from ladder stock 11 by severing side members 13 and 15 at the approximate midpoint between successive cross-links 17. Fastener 18 comprises a pair of cross-bars 19 and 21 which are interconnected by a thin, flexible filament 23, with cross-bars 19 and 21 comprising sections of side members 13 and 15, respectively, and filament comprising a cross-link 17.

Automated plastic fastener dispensing devices, or machines, are well known in the art and are commonly used to dispense individual plastic fasteners from a reel of ladder-type fastener stock.

In U.S. Pat. No. 8,413,866 to W. J. Cooper et al., the disclosure of which is incorporated herein by reference, there is disclosed one well known type of plastic fastener dispensing device that is presently manufactured and sold by Avery Dennison Corporation of Pasadena, California as the ST9500® fastener system, the fastener dispensing device being shown in FIG. 2 and identified generally by reference numeral 30. As can be seen, fastener dispensing device 30 is designed to dispense individual plastic fasteners from a reel of continuously-connected ladder stock 11.

Fastener dispensing device 30 comprises a substantially rectangular base 31 which provides a structural foundation for the machine, base 30 including a plurality of transverse bores 32 at select locations about its periphery through which fastening elements (not shown) can be driven in order to secure device 30 to a workstation or other similar platform. A solid, block-shaped neck 33 is integrally formed onto the top surface of base 31 along its rear edge. In turn, an enlarged, open, rectangular frame 34 is formed on top of neck 33 that serves as a support surface on which various mechanical and electrical components for device 30 are mounted.

An elongated support, or reactor, arm 35 extends out from base 31 and neck 33 in the forward and upward direction, support arm 35 extending beneath the underside of frame 34 in a spaced apart relationship relative thereto. A reactor plate 37 is removably mounted onto the free end of support arm 35 and functions, among other things, to directly support the articles to be coupled by one or more fasteners 18 using device 10, as will be described further below.

A substantially enclosed, protective housing 39 extends upwardly about the periphery of frame 34. Housing 39 is preferably constructed of a rigid, durable and impact-resistant material, such as plastic, and serves to protect the majority of the electrical and mechanical components for device 30 that are mounted on frame 34.

An arcuate recess 41 is formed in the top surface of housing 39. A cylindrical reel holder 43, which is mounted onto housing 39, extends laterally through recess 41 and is dimensioned to pass axially through a longitudinal bore formed in a reel, or spool, 45 around which ladder stock 11 is wound. Accordingly, holder 43 serves to support reel 45 within recess 41 and enable reel 45 to rotate freely during normal operation, thereby rendering device 10 capable of continuously dispensing plastic fasteners in an automated fashion.

Fastener dispensing device 30 comprises a motor-driven head assembly 53 that is mounted on frame 34 along its front end. Head assembly 53 is primarily responsible for dispensing an individual fastener 18 from ladder stock 11. Specifically, head assembly 53 includes a vertically extending mount 55 that is fixedly retained in place on frame 34, mount 55 being generally U-shaped in lateral cross-section. A motor-driven, vertically displaceable head 57 is slidably coupled to mount 55 for purposes to become apparent below.

Head assembly 53 additionally includes a pair of hollow, slotted needles 59-1 and 59-2 that is coupled to vertically displaceable head 57 and is therefore adapted to selectively penetrate through the one or more items to be fastened, a feed mechanism 61 for advancing side members 13 and 15 of ladder stock 11 into axial alignment behind the longitudinal bores defined by needles 59-1 and 59-2, respectively, a severing mechanism 53 for cutting side members 13 and 15 of ladder stock 11 at the approximate midpoint between successive cross-links 17 to separate an individual plastic fastener 18 from the remainder of ladder stock 11, and an ejection mechanism 65 for ejecting cross-bars 19 and 21 of the severed fastener 18 through the bores of the pair of hollowed needles 59 and, in turn, through the one or more items previously penetrated by needles 59.

As referenced briefly above, reactor arm 35 is a narrow support member that terminates beneath the sharpened tips of the pair of needles 59. Reactor plate 37, which is preferably constructed out of steel or another suitably durable material, is removably mounted onto the top surface of reactor arm 35 at its free end. As such, reactor plate 37 is disposed in direct alignment beneath the sharpened tips of the pair of needles 59 prior to activation of machine 30. For aesthetics and ease of operation, the top and side surfaces of reactor plate 37 preferably lie generally flush with the corresponding top and side surfaces of the reactor arm 35 so to create a seamless, integrated, finger-like support surface.

As can be seen, reactor plate 37 is provided with a single, narrow slot 67 that extends the majority of its width. During normal operation of machine 30, slot 67 receives the pair of needles 59 as head 57 is drivers vertically downward, thereby enabling the sharpened tip of each needle 59 to penetrate through the articles supported by reactor plate 37 to a depth sufficient to allow for the subsequent ejection of each cross-bar of a dispensed fastener.

In the above-described embodiment of reactor plate 37, slot 67 extends laterally a significant width in order to (i) accommodate fastener dispensing machines with variable needle spacing (i.e., machines that allow for the spacing between needles to be adjusted) and (ii) allow for slight lateral deflection, or bending, of each needle when penetrating through certain types of materials.

However, fastener dispensing devices of the type described above which include a reactor plate with a single widened slot have been found to suffer from a notable shortcoming. Specifically, due to the inclusion of the widened slot, the reactor plate has been found to inadequately support articles during the fastener dispensing process. In particular, instead of penetrating through the supported articles that are to be fastened, the pair of needles often pushes, or wedges, certain types of materials (e.g., fabric, paper and denim) down into the slot, which is highly undesirable for at least the reasons to he set forth below.

As a first drawback, the inadequate support afforded by reactor plates of the type as described above can cause damage to the articles if pushed too deeply into the lateral slot. Specifically, articles constructed out of relatively delicate materials can become distorted or even torn by the pressure exerted thereon by the pair of needles.

As a second drawback, the inadequate support afforded by reactor plates of the type as descried above often results in the ineffective fastening of articles. More specifically, the inadequate support afforded by reactor plates of the type as described above can result in, inter alia, (i) an increased degree of stress imparted onto the fastener filament during ejection which, in turn, can cause the fastener to break, (ii) an inability of each needle and, as a consequence, each fastener T-end to fully penetrate the article, and (iii) creation of an enlarged hole in the articles by each needle, with the diameter of each hole being too large to retain the 0.1875 inch diameter T-end of a conventional plastic fastener.

In view of the above, it is known in the art for a brush assembly to be coupled to a reactor plate to provide more uniformly distributed article support within the region of the reactor plate through which the needles are designed to selectively penetrate. For example, in U.S. Pat. No. 6,244,490 to S. E. Flannery et al., the disclosure of which is incorporated herein by reference, there is shown a reactor plate assembly which serves as an anvil for a plastic fastener dispensing device, the reactor plate assembly comprising a brush assembly that is mounted on a reactor plate. The reactor plate includes a top surface, a bottom surface and an opening therethrough. The brush assembly includes a high density polyethylene mounting blocking having a top surface, a bottom surface and a recess formed in the top surface. The brush assembly also includes a plurality of nylon brush filaments which are coupled to and extend out from the recess in the mounting block. The brush assembly is mounted on the bottom surface of the reactor plate by screws so that a portion of the plurality of filaments protrudes into the opening in the reactor plate with the free ends of the plurality of filaments lying flush with the op surface of the reactor plate.

Although useful in supporting articles to be fastened, reactor plate assemblies of the type as described above have been found to be unnecessarily large in size and, as a result, are aesthetically unappealing. Specifically, the brush assembly shown in the '490 patent includes an enlarged, square-shaped arrangement of filaments that penetrates through a similarly dimensioned opening in the reactor plate. However, it is to be understood that the surface area of the support region provided by such a brush assembly is unnecessarily large since the pair of needles is only typically designed to move in the lateral direction and therefore does not require a similar range of support in the front-to-back direction. As a consequence, the mounting block for the brush assembly cannot be integrated into the reactor plate in a seamless and inconspicuous manner but, rather, is largely obtrusive in nature.

SUMMARY OF THE INVENTION

It is an object of the present invention to provide a new and improved reactor plate assembly for a plastic fastener dispensing device.

It is another object of the present invention to provide a reactor plate assembly of the type as described above that provides adequate support to articles that are to be coupled together with one or more fasteners dispensed from the device.

It is yet another object of the present invention to provide a reactor plate assembly of the type as described above that enables a pair of hollow needles for the device to fully penetrate through the articles to be coupled together with one or more fasteners.

It is still another object of he present invention to provide a reactor plate assembly of the type as described above that is seamless in its construction and that does not detract from the overall style and design of the fastener dispensing device.

It is yet still another object of the present invention to provide a reactor plate assembly that has a limited number of parts, is easy to use and is inexpensive to manufacture.

Accordingly, as one feature of the present invention, there is provided reactor plate assembly for a plastic fastener dispensing device, the reactor plate assembly comprising (a) a reactor plate, the reactor plate being shaped to define first and second needle receiving holes, and (b) a brush anvil coupled to the reactor plate, the brush anvil comprising (i) a base, and (ii) a plurality of bristle clusters coupled to the base, wherein at least one of the plurality of bristle clusters at least partially projects into the first needle receiving hole in the reactor plate and at least another one of the plurality of bristle clusters at least partially projects into the second needle receiving hole in the reactor plate.

Various other features and advantages will appear from the description to follow. In the description, reference is made to the accompanying drawings which form a part thereof, and in which is shown by way of illustration, various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts:

FIG. 5(*b*) is a left side view of the base for the anvil shown in FIG. 5(*a*);

FIG. 5(*c*) is a section view of the base for the anvil shown in FIG. 5(*a*), taken along lines 5C-5C;

FIG. 5(*d*) is a section view of the base for the anvil shown in FIG. 5(*a*), taken along lines 5D-5D.

DETAILED DESCRIPTION OF THE INVENTION

Figure 1:
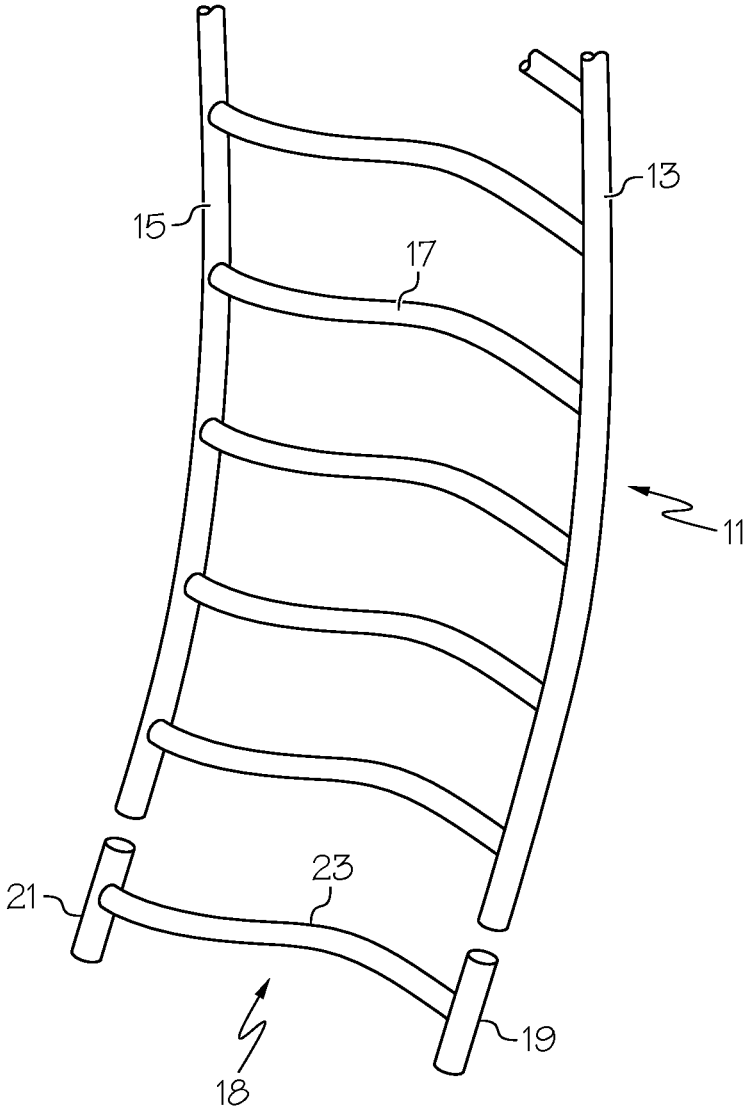
FIG. 1 (PRIOR ART)
FIG. 1 is an enlarged, fragmentary, front perspective view of a length of continuously connected ladder stock that is known in the art.
Figure 2:
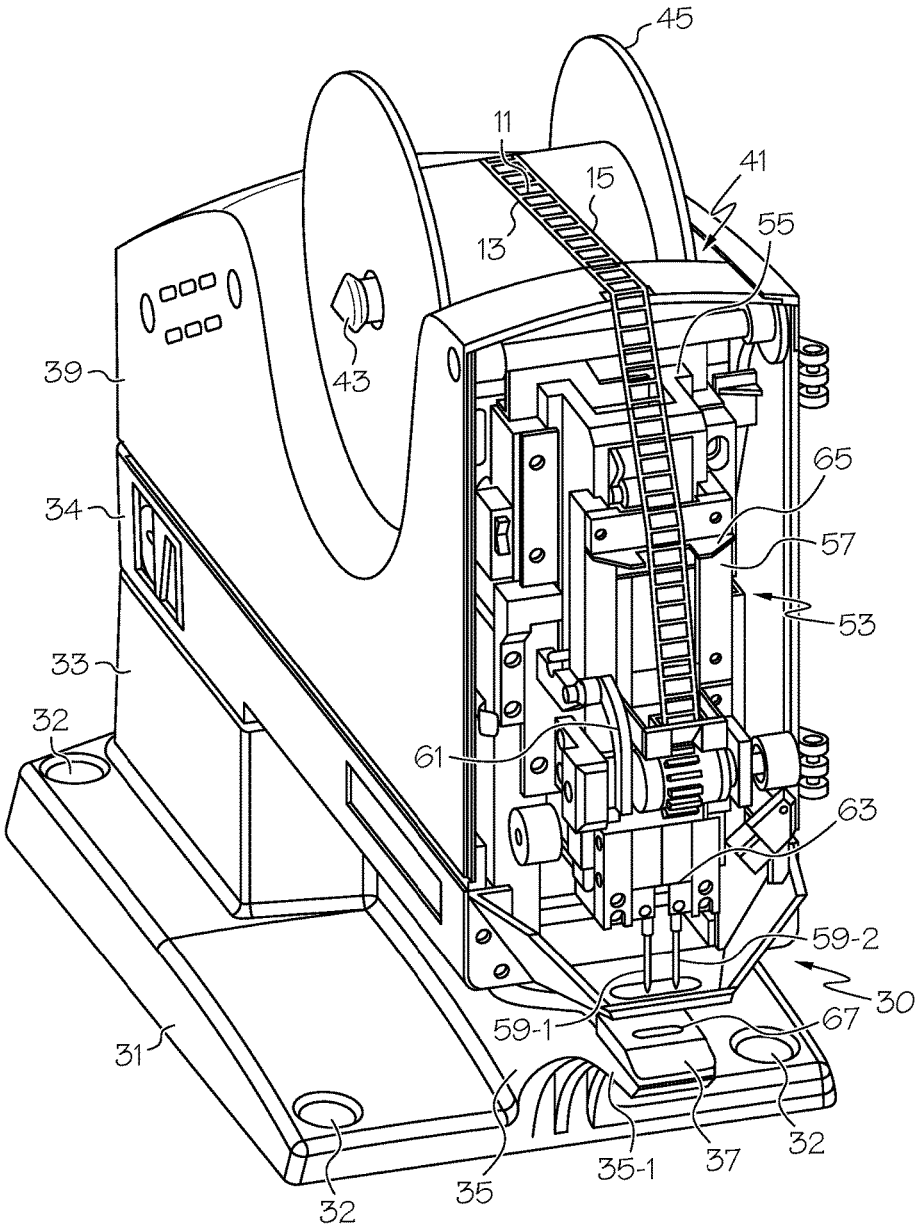
FIG. 2 (PRIOR ART)
FIG. 2 is a front perspective view of a plastic fastener dispensing device that is known in the art, the device being shown supplied with a reel of the ladder stock shown in FIG. 1, the device being shown with its front door removed therefrom for purposes of simplicity and clarity.
Figure 3:
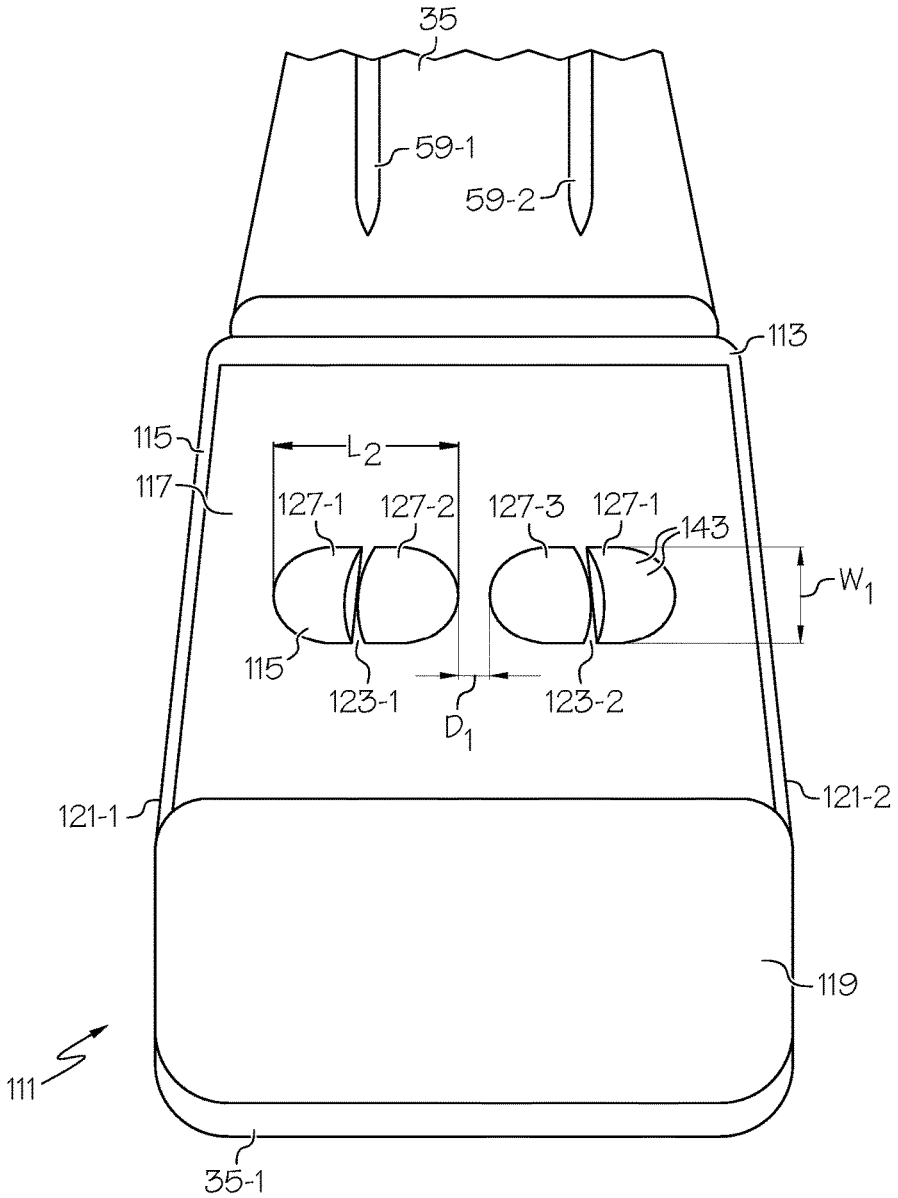
FIG. 3 is an enlarged, fragmentary, front perspective view of a reactor plate assembly constructed according to the teachings of the present invention, the reactor plate assembly being shown mounted on the support arm of a plastic fastener dispensing device.

Referring now to FIG. 3, there is a shown a reactor plate assembly for a fastener dispensing device, the reactor plate assembly being constructed according to the teachings of the present invention and identified generally by reference numeral 111. As will be described in detail below, reactor plate assembly 111 is designed to be installed on a fastener dispensing device and, in use, serves to provide support to articles during the fastener dispensing process.

Reactor plate assembly 111 is designed to be seamlessly mounted onto the free end of the support arm for a dual-needle fastener dispensing device. For illustrative purposes only, reactor plate assembly 111 is shown herein replacing reactor plate 37 of prior art fastener dispensing device 30. However, it is to be understood that reactor plate assembly 111 is not limited for use with fastener dispensing device 30 but, rather, could be similarly utilized with other types of fastener dispensing devices without departing from the spirit of the present invention.

Reactor plate assembly 111 comprises a reactor plate 113 and a brush anvil 115 that are removably coupled together. As can be seen, reactor plate 113 and brush anvil 115 together form an effective article support surface that is mounted onto the free end of reactor arm 35 in a seamless and inconspicuous manner, which is a principal object of the present invention.

Reactor plate 113 is sir similar in construction to reactor plate 37 of prior art device 30 in that reactor plate 113 is formed as a unitary, shield-like member that is preferably constructed of a highly rigid and durable material, such as steel, to protect reactor arm 35 from inadvertently harmful contact from either the articles to be coupled or needles 59.

Reactor plate 113 is shaped to include an enlarged, flattened top surface 117, a downwardly tapered, or angled, front surface 119, and opposing shortened side surfaces 121-1 and 121-2. As can be appreciated, distal end 35-1 of reactor arm 35 includes a recess in its top surface that is dimensioned to receive reactor plate 113 such that top surface 117 and side surfaces 121 lie generally flush with the corresponding top and side surfaces of reactor arm 35, thereby resulting in a seamless design. Furthermore, the downward taper of front surface 119 reduces the overall thickness of the resulting support surface at its free end, thereby facilitating the process of positioning articles thereon for subsequent coupling with plastic fasteners.

Reactor plate 113 differs from reactor plate 37 primarily in that reactor plate 113 includes two, generally elliptical holes 123-1 and 123-2 rather than a single, elongated, lateral slot. Each hole 123 has a length $L_1$ of approximately 7.0 mm and a width $W_1$ of approximately 3.0 mm. Elliptical holes 123 are disposed side-by-side (i.e., such that the major axes, or transverse diameters, of holes 123 extend in a collinear fashion) and are spaced slightly apart from one another a distance $D_1$ of approximately 1.0 mm.

As will be described further below, each elliptical hole 123 is aligned to receive a corresponding needle 59 upon penetration through the particular articles to be fastened. The utilization of a pair of separate needle-receiving holes 123, as well as brush anvil 115, limits the amount of material that can be pushed into holes 123 by needles 59 during the fastening dispensing process and thereby resolves many of the shortcomings typically associated with reactor plates that include a single, widened slot, such as prior art reactor plate 37.

Figure 4A:
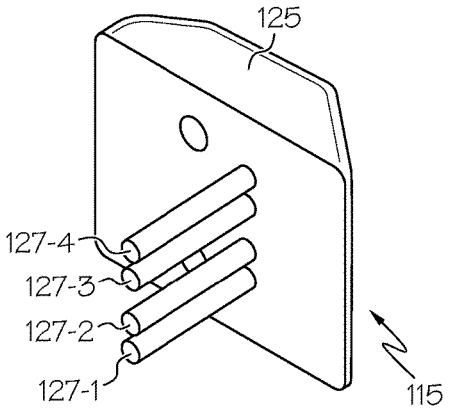
FIGS. 4(*a*)-(*c*) are perspective, top and left side views, respectively, of the anvil shown in FIG. 3, each bristle cluster being represented as a single enlarged bristle for ease of illustration.
Figure 4B:
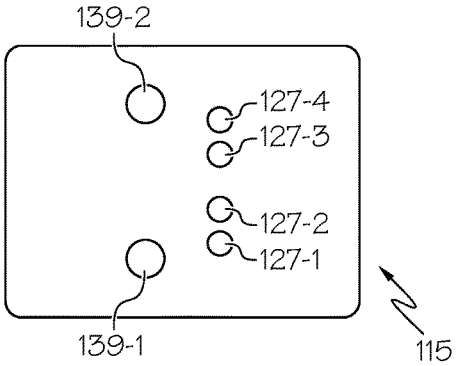
Figure 4C:
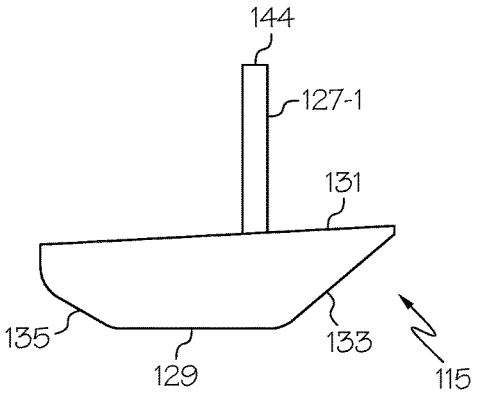
Figure 5A:
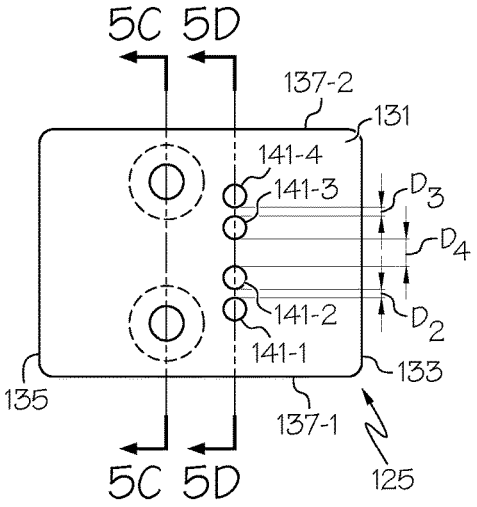
FIG. 5(*a*) is a top view of the base for the anvil shown in FIG. 4(*a*)
Figure 5B:
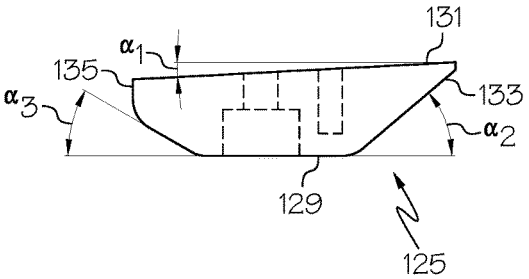
Figure 5C:
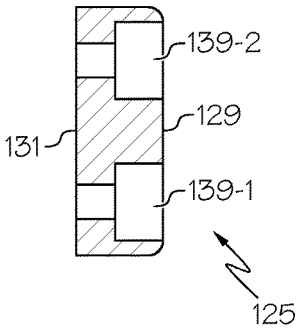
Figure 5D:
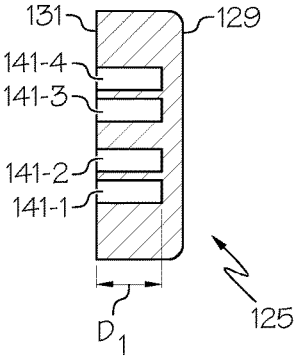

Referring now to FIGS. 4(*a*)-(*c*), brush anvil 115 comprises a brush block, or base, 125 and four bristle clusters, or tufts, 127-1 thru 127-4 that are separately mounted onto base 125 and project outwardly therefrom, each bristle cluster 127 being represented in FIGS. 4(*a*)-(*c*) as a single, enlarged bristle for ease of illustration purposes only. As will be described further below, brush anvil 115 is adapted to be mounted onto the underside of distal end 35-1 such that bristle clusters 127-1 and 127-2 project into hole 123-1 and bristle clusters 127-3 and 127-4 project into hole 123-2, thereby further reducing the risk of material being pushed into holes 123 by needles 59 during the fastening dispensing process, which is a principal object of the present invention.

Referring now to FIGS. 4(*a*)-(*c*) and 5(*a*)-(*d*), base 125 is formed as a unitary block that is preferably constructed out of a rigid, durable and inexpensive material, such as polyvinylchloride (PVC). As can be seen, base 125 includes a flat bottom wall 129, a flat top wall 131, a front wall 133, a rear wall 135 and a pair of opposing, flattened sidewalls 137-1 and 137-2.

Base 125 is shaped to seamlessly integrate with reactor arm 35 as well as reactor plate 37 and thereby minimize its conspicuousness when mounted. Specifically, top wall 131 is provided with a slight downward pitch angle $\alpha_1$ of approximately 3 degrees in the rearward direction. Similarly, front wall 133 has an upward pitch angle $\alpha_2$ of approximately 40 degrees in the forward direction and is slightly rounded at its junction with top wall 131. Furthermore, rear wall 135 has an upward pitch angle $\alpha_3$ of approximately 30 degrees in the rearward direction and is largely rounded at its junction with top wall 131.

Base 125 is shaped to define a pair of transverse, mounting, or through, holes 139-1 and 139-2, each through hole 139 being countersunk in bottom wall 129. Accordingly, it is to be understood that brush anvil 115 is adapted to be mounted onto support arm 35 by inserting an appropriately dimensioned fastening element (e.g., an enlarged head, hex screw) into each through hole 139 through bottom wall 129 and, in turn, into threaded engagement with a corresponding threaded bore formed in the underside of distal end 35-1.

Base 125 is additionally shaped to define four, similarly dimensioned, cluster-receiving bares 141-1 thru 141-4. Each cluster-receiving bore 141 is generally circular in transverse cross-section with a diameter of approximately 3.0 mm and penetrates partially into base 125 from top wall 131 to a depth $D_1$ of approximately 8.0 mm.

As seen most clearly in FIG. 5(*a*), bores 141 are linearly arranged, with bores 141-1 and 141-2 spaced apart a distance $D_2$ of approximately 1.0 mm and bores 141-3 and 143-4 similarly spaced apart a distance $D_3$ of approximately 1.0 mm. Bores 141-2 and 141-3 are spaced apart a larger distance C) of approximately 3.0 mm, thereby separating bores 141-1 thru 141-4 into two distinct sets, or groups, of bores for reasons to become apparent below.

Referring back to FIGS. 3 and 4(*a*)-(*c*), bristle clusters 127-1 thru 127-4 are disposed in bores 141-1 thru 141-4, respectively. Preferably, each cluster 127 is retained in its corresponding bore 141 through both a fitted relationship with base 125 as well as the use of a suitable adhesive, such as epoxy.

Each cluster 127 preferably includes a plurality of individual bristles 143 that extends in parallel with one another and that is held, or grouped, tightly together to form a generally cylindrical bunch. Each bristle 143 is preferably constructed of a substantially strong yet flexible material, such as nylon, and is formed as an elongated, cylindrical strand that is approximately 0.4 mm in diameter and approximately 27.5 mm in length. Due to its construction, each bristle 143 is designed to bend, or laterally deflect, upon the application of a downward force on its free end. Upon removal of the downward force, each bristle 143 resiliently returns to its original orientation in relation to base 125.

As referenced briefly above, the plurality of individual bristles 143 that form each cluster 127 is bundled as a generally cylindrical group and is, in turn, axially inserted down into its respective bore 141. Due to the uniformity of dimensions, the free ends 144 of bristles 143 for all four clusters 127 line in a generally planar relationship, as seers in FIGS. 4(*a*) and 4(*c*).

With base 125 properly secured to the underside of distal end 35-1, bristle clusters 127-1 and 127-2 project through and substantially fill hole 123-1 in reactor plate 113 whereas bristle clusters 127-3 and 127-4 project through and substantially fill hole 123-2 in reactor plate 113, as shown in FIG. 3. Preferably, each bristle 143 is of a length such that its free end lies substantially flush with top surface 117. In this capacity, top surface 117 and bristles 143 together provide a near uniform, planar support surface for articles to be fastened.

Figure 6:
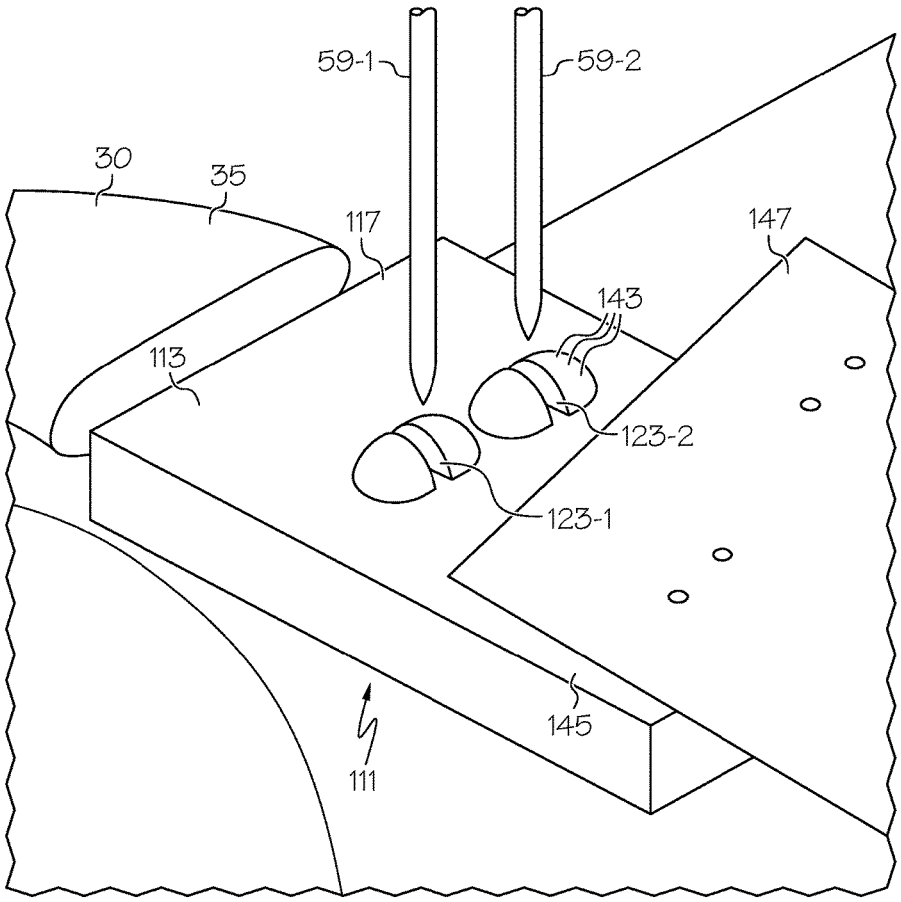
FIG. 6 is an enlarged, left side perspective view of the reactor plate assembly shown in FIG. 3, the reactor plate being shown with a pair of articles that are to be fastened together.

In use, reactor plate assembly 111 is designed to be installed on reactor arm 35 of fastener dispensing device 30 in the manner set forth in detail above and as shown in FIG. 6. Mounted as such, the relatively high density of bristles 143 and top surface 117 of reactor plate 113 together create a strong, planar surface, or anvil, that can appropriately support a pair of articles 145 and 147 (in this case, a pair of jeans and a merchandise tag) during the fastening dispensing process. In particular, reactor plate assembly 111 is suitably designed to support articles 145 and 147 during their penetration by needles 59-1 and 59-2.

As a principal feature of the present invention, the ability of each bristle 143 to bend, or laterally deflect, ensures that needles 59-1 and 59-2 are able to penetrate through articles 145 and 147 and down into respective holes 123-1 and 123-2. In other words, if either needle 59, which typically has a diameter of approximately 0.085 inches and is downwardly urged with approximately 30 pounds of force, projects down onto the free end of an individual bristle 143, the downward force applied by needle 59 causes bristle 143 to laterally deflect to the extent necessary that needle 59 can penetrate to its required depth. As a consequence, reactor plate assembly 111 provides adequate support to articles 145 and 147 but, at the same time, does not inhibit penetration therethrough by needles 59, which is highly desirable.

The embodiment shown above is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A reactor plate assembly for a plastic fastener dispensing device, the reactor plate assembly comprising:

(a) a reactor plate, the reactor plate being shaped to define first and second needle receiving holes; and (b) a brush anvil coupled to the reactor plate, the brush anvil comprising:

(i) a base; and (ii) a plurality of bristle clusters coupled to the base, wherein at least one of the plurality of bristle clusters at least partially projects into the first needle receiving hole in the reactor plate and at least another one of the plurality of bristle clusters at least partially projects into the second needle receiving hole in the reactor plate and the base for the brush anvil includes a pair of mounting holes, the pair of mounting holes extending transversely through the base from the top wall to the bottom wall.

2. The reactor plate assembly of claim 1 wherein the brush anvil includes first, second, third and fourth bristle clusters.

3. The reactor plate assembly of claim 2 wherein the first and second bristle clusters project into the first needle receiving hole in the reactor plate and the third and fourth bristle clusters project into the second needle receiving hole in the reactor plate.

4. The reactor plate assembly of claim 3 wherein each bristle cluster comprises a plurality of individual bristles, each of the plurality of bristles having a free end.

5. The reactor plate assembly of claim 4 wherein the free ends of the plurality of individual bristles for the first, second, third and fourth bristle clusters are coplanar.

6. The reactor plate assembly of claim 5 wherein the reactor plate comprises a flattened top surface, an angled front surface and opposing side surfaces.

7. The reactor plate assembly of claim 6 wherein the free end of the plurality of individual bristles for the first, second, third and fourth bristle clusters lie flush with the top surface of the reactor plate.

8. The reactor plate assembly of claim 7 wherein the pair of needle receiving holes is formed in the flattened top surface of the reactor plate in a spaced apart, side-by-side relationship.

9. The reactor plate assembly of claim 8 wherein each of the pair of needle receiving holes is elliptical in transverse cross-section.

10. The reactor plate assembly of claim 1 wherein the base for the brush anvil includes a flat bottom wall, a flat top wall and angled front wall, an angled rear wall and a pair of opposing sidewalls.

11. The reactor plate assembly of claim 10 wherein the base is shaped to define a plurality of bores, each of the plurality of bores penetrating partially into base from the top wall and being dimensioned to receive one of the plurality of bristle clusters.

12. The reactor plate assembly of claim 11 wherein the plurality of bores formed in the base is linearly arranged.

13. The reactor plate assembly for claim 1 wherein each of the pair of mounting holes is countersunk in the bottom wall.

* * * * *